US009022262B2

(12) United States Patent
Pellegrini

(10) Patent No.: US 9,022,262 B2
(45) Date of Patent: May 5, 2015

(54) HANDGUN HOLSTER HAVING A SAFETY LOCK FOR ENGAGEMENT WITH THE SPENT CASING EJECTION PORT OF THE HANDGUN

(75) Inventor: Paolo Pellegrini, Fucecchio (IT)

(73) Assignee: Radar Leather Division, S.R.L., Fucecchio (Firenze) (IT)

( * ) Notice: Subject to any disclaimer, the term of this patent is extended or adjusted under 35 U.S.C. 154(b) by 38 days.

(21) Appl. No.: 14/113,152

(22) PCT Filed: May 9, 2012

(86) PCT No.: PCT/IB2012/052308

§ 371 (c)(1),
(2), (4) Date: Nov. 4, 2013

(87) PCT Pub. No.: WO2012/153279

PCT Pub. Date: Nov. 15, 2012

(65) Prior Publication Data

US 2014/0042196 A1 Feb. 13, 2014

(30) Foreign Application Priority Data

May 10, 2011 (IT) ..... FI2011A0099

(51) Int. Cl.
*F41C 33/00* (2006.01)
*F41C 33/02* (2006.01)

(52) U.S. Cl.
CPC ..... *F41C 33/0263* (2013.01); *F41C 33/0227* (2013.01); *Y10S 224/912* (2013.01)

(58) Field of Classification Search
CPC ..... F41C 33/00; F41C 33/0254
USPC ..... 224/192–193, 198, 238, 243, 912
See application file for complete search history.

(56) References Cited

U.S. PATENT DOCUMENTS

| | | | | |
|---|---|---|---|---|
| 2005/0035162 | A1 | 2/2005 | Lowe et al. | |
| 2005/0035163 | A1 | 2/2005 | French et al. | |
| 2005/0040195 | A1 * | 2/2005 | Lowe et al. | 224/243 |
| 2006/0180620 | A1 * | 8/2006 | Senn et al. | 224/243 |
| 2007/0181619 | A1 | 8/2007 | Seyfert et al. | |
| 2009/0294496 | A1 * | 12/2009 | Gallagher | 224/243 |
| 2009/0321480 | A1 * | 12/2009 | Kincaid et al. | 224/243 |
| 2011/0174849 | A1 * | 7/2011 | Clifton, Jr. | 224/243 |
| 2011/0174850 | A1 * | 7/2011 | Clifton, Jr. | 224/243 |

FOREIGN PATENT DOCUMENTS

DE 197 10 532 A1 9/1998

OTHER PUBLICATIONS

International Search Report of PCT/IB2012/052308 dated Aug. 20, 2012.

* cited by examiner

*Primary Examiner* — Justin Larson
*Assistant Examiner* — Phillip Schmidt
(74) *Attorney, Agent, or Firm* — Lucas & Mercanti, LLP

(57) ABSTRACT

The present invention refers to an improved holster for handguns provided with a spent casing ejection port, adapted to prevent the accidental drop or an unauthorized extraction of the handgun, thanks to a safety device embodied in the same holster and engaging with the ejection port.

11 Claims, 3 Drawing Sheets

HANDGUN HOLSTER HAVING A SAFETY LOCK FOR ENGAGEMENT WITH THE SPENT CASING EJECTION PORT OF THE HANDGUN

CROSS-REFERENCE TO RELATED APPLICATIONS

This application is a 371 of PCT/IB2012/1052308, filed May 9, 2012, which claims the benefit of Italian Patent Application No. FI2011A000099, filed May 10, 2010, the contents of each of which are incorporated herein by reference.

FIELD OF THE INVENTION

The present invention refers to the field of safety devices for guns and, more precisely, to an improved holster for handguns having a spent casing ejection port. The holster, thanks to a safety lock engaging with the ejection port, is adapted to prevent the accidental or unauthorized extraction of the gun from the same holster.

BACKGROUND OF THE INVENTION

As known, handgun holsters, in particular those in use by police officers and surveillance staff for defending people and goods, must be designed so as to hold the gun firmly, not only during the normal movements of the user but also when more intense physical efforts, or fights or similar circumstances occur, ensuring nonetheless an easy and quick gun extraction by the user, when needed.

Various safety devices are provided to such purpose, locking the gun inside the holster when not in use, allowing for a somehow quick release when necessary. In fact, these safety devices, if on the one hand must effectively fasten the gun to the holster when the same gun is at rest, on the other hand they must let the gun be easily and promptly extracted as soon as the necessity arises.

Among the different safety devices proposed until presently, there are devices exploiting the spent casing ejection port of the handgun as an engagement seating for a locking member locking the gun within the holster.

U.S. Pat. No. 6,769,581 discloses for instance a device comprising a fixed projecting tooth arranged within the holster and adapted to engage with the ejection port of the gun to keep it locked in position. The disengagement/unlocking is in this case carried out with a suitably driven displacements of the gun; such displacements are made possible only pursuant to the release of supplementary locking means.

The release of the gun is in this case unreliable, being it related with a particular displacement of the gun that the user must accomplish without any mechanical guidance. This can be troublesome, especially in danger situations when a quick extraction of the gun from the holster is vital.

PCT publication WO2007/092008 discloses a device similar to that just described, in which the safety lock of the gun in the holster occurs through the ejection port, with a supplementary device or tension setter is mounted inside the holster in order to assist a correct positioning of the gun with respect to the locking device, thus somehow guiding the user towards the correct movements required to lock and unlock the gun. The provision of a supplementary device, furthermore with a limited adaptation capability to different handgun models, makes this solution not fully satisfactory in terms of simple construction and easy use.

The ejection port is also exploited in the holsters disclosed in U.S. Pat. No. 7,140,523 and U.S. Pat. No. 6,886,725. In these holsters the port is engaged by a locking movable member, in particular the end of a lever which to be actuated by the user.

More specifically, this type of known device comprises a lever at the ends of which there are arranged, respectively, a docking plate that engages with the ejection port of the gun, and a release plate, placed adjacent with the trigger guard to be actuated by the user with a push carried out by flexing a finger, e.g. the forefinger. This device further comprises a tube within the holster, in which the user needs insert the finger in order to contact and drive the release plate. The tube has therefore the function of sheltering and protecting the release plate, so as not to permit an actuation by an assailant, or an accidental and/or unintentional actuation by the same user. Also this release system is in any case uncomfortable and inconvenient: the actuation of the release plate must in fact be carried out in the area of the trigger guard, thus very deeply inside the holster, even inserting the finger in a long tube (also with possible problems for people having bulky fingers). This device is also unsuitable for guns provided with tactical lights, laser sights or the like, encumbering the area of the trigger guard.

In US2007/181619 a holster having the features in the preamble of annexed claim 1 is disclosed. 1. The holster includes internal latch means rocking about a transverse axis joining the main side walls of the holster, and engaging with the ejection port of the gun. The release of the latch means is driven by a release lever with an end to be operated by the thumb of the user and arranged at a certain depth.

Even this system is however lacking of ergonomic and convenience characteristics, considering also the reduced space between the holster and the body of the user, being it the space in which the thumb has to be inserted for seeking contact with the release lever actuation end (this being a relatively small target).

It remains therefore deeply felt the need for an improvement safety device for holsters that, being adapted to any different type of handguns, is particularly reliable and convenient for the user.

SUMMARY OF THE INVENTION

The main object of the present invention is to provide a safety holster with a docking device for handguns having a spent casing ejection port, in which the release of the locking device can be actuated only or also with a more convenient and effective finger movement that the thumb actuation of the prior holsters.

This and other objects are achieved with the improved handgun holster according to the invention, having the essential characteristics defined by the first of the appended claims.

Further important characteristics of the present improved holster are defined by the dependent claims.

BRIEF DESCRIPTION OF THE DRAWINGS

The features and advantages of the holster according to the invention will be apparent from the following description of an embodiment thereof, which is given merely by way of a non-limiting example, with reference to the attached drawings, in which.

DETAILED DESCRIPTION OF THE INVENTION

Figure 1:
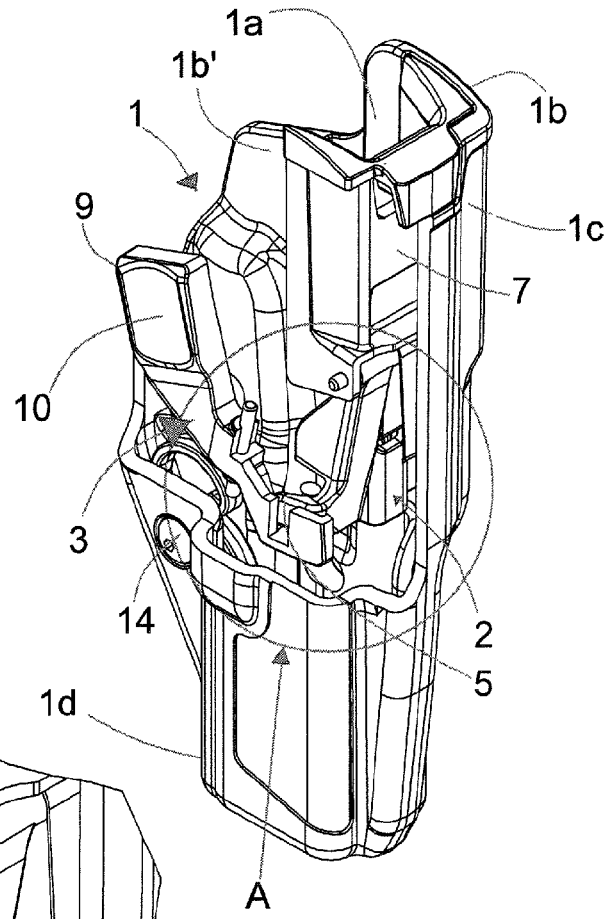
FIG. 1 is a front perspective view of a holster according to the invention, partially broken, having a safety lock actuated with the forefinger of a user's hand.
Figure 2:
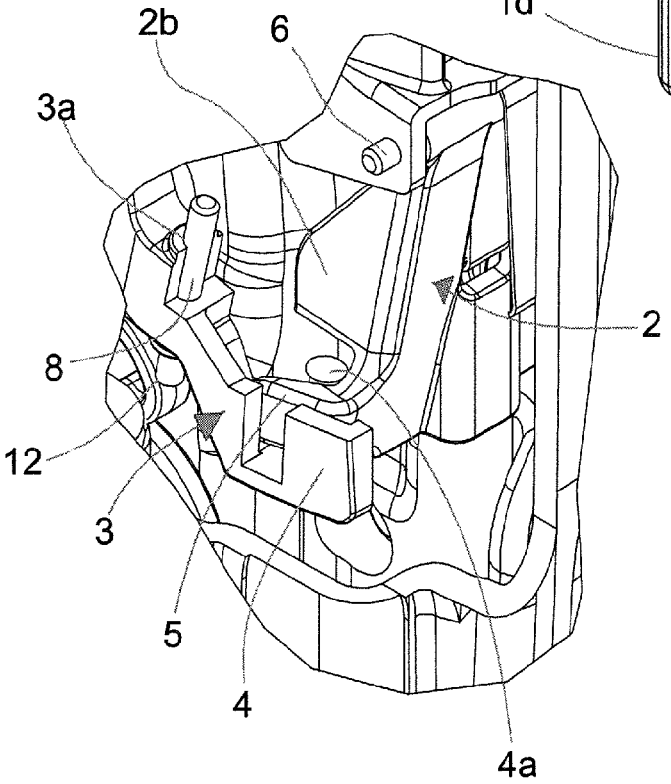
FIG. 2 is an enlargement of the holster in FIG. 1, as encircled by the shadow line A of the same figure.

Referring to the above figures, a holster according to the invention comprises a hollow body 1 adapted to house a gun, in particular a gun with a spent casing ejection port, which is inserted through an opening la of the body 1 and, when accommodated inside, projects partially outside with its stock. The body 1 comprises two substantially parallel side walls 1*b*, connected frontally and at the back by a front wall 1*c* and a back wall 1*d*, respectively. For the sake of clarity, one of the side walls 1*b*' is broken in FIGS. 1 and 2.

The holster further comprises a locking device for locking the gun against its extraction, generally indicated at 2 and adapted to engage with the ejection port, and a release device 3 of the locking device 2 to be actuated with the pressure of the forefinger of the user's hand, so that pursuant to exerting such pressure the device 2 rocks about a crosswise axis (that is an axis extending transversely between the two side walls 1*c*) and consequently disengages from the ejection port of the gun.

The locking device is a U-shaped latch 2 having a seat 2*a* for fixed engagement with a crosswise pin 6 that bridges the two side walls substantially orthogonally therewith. More precisely, the pin 6 is pivotally mounted on a shell-like insert 7 that reinforces the top of the front wall 1*c* and of the side walls 1*b* in a region enclosing the opening 1*a*. The pin 6 runs along a top edge of the latch 2, the lower free end of which has a sideways slanting peg 5 that will be described hereafter. A flat spring 13 is associated to the latch 2 for biasing the same towards a position lifted inside the body (that is, away from the front wall 1*c*) corresponding to the engagement/locking position with the ejection port. This engagement is in particular due to side wings 2*b* adapted to enter the ejection port for an abutting hindrance against the extraction of the gun.

The release device is a lever 3 pivotally mounted on the outside of side wall 1*b*' of the body around an axis substantially parallel with said side wall 1*b*', and slightly spaced from it towards the outside. More precisely, such axis is defined by a pivot 8 supported by a ridge 12 projecting from the side wall and following a path that encircles the periphery of the lever 3, thus enclosing a housing 12*a* for the same lever. The lever 3 has a central seat 3*a* for rotatable engagement with the pivot 8, which has a substantially longitudinal arrangement (i.e. along a direction corresponding to the axis of the barrel of the gun in its housing arrangement within the body), but slightly inclined, the lower end of the pivot being closer to the rear wall ld than the top end.

The lever 3 has an actuation end 9 in a top-back region of the body, and a catching end 4 for engagement with the latch 2 adjacent with the front wall 1*c*, at a substantially intermediate depth of the longitudinal development of the body. The actuation end 9 has a flat development with a wide outer recess 10 for ergonomic contact with the fleshy part of the first phalanx of the forefinger. In correspondence with the recess 10 the side wall 1*b*' has a fracture le within the housing 12*a*, making it easier for the end 9 to be pressed towards the body 1, with a consequent rotation of the lever 3 around the pin 8 and a lifting of the catching end 4 away from the same side wall.

Figure 3:
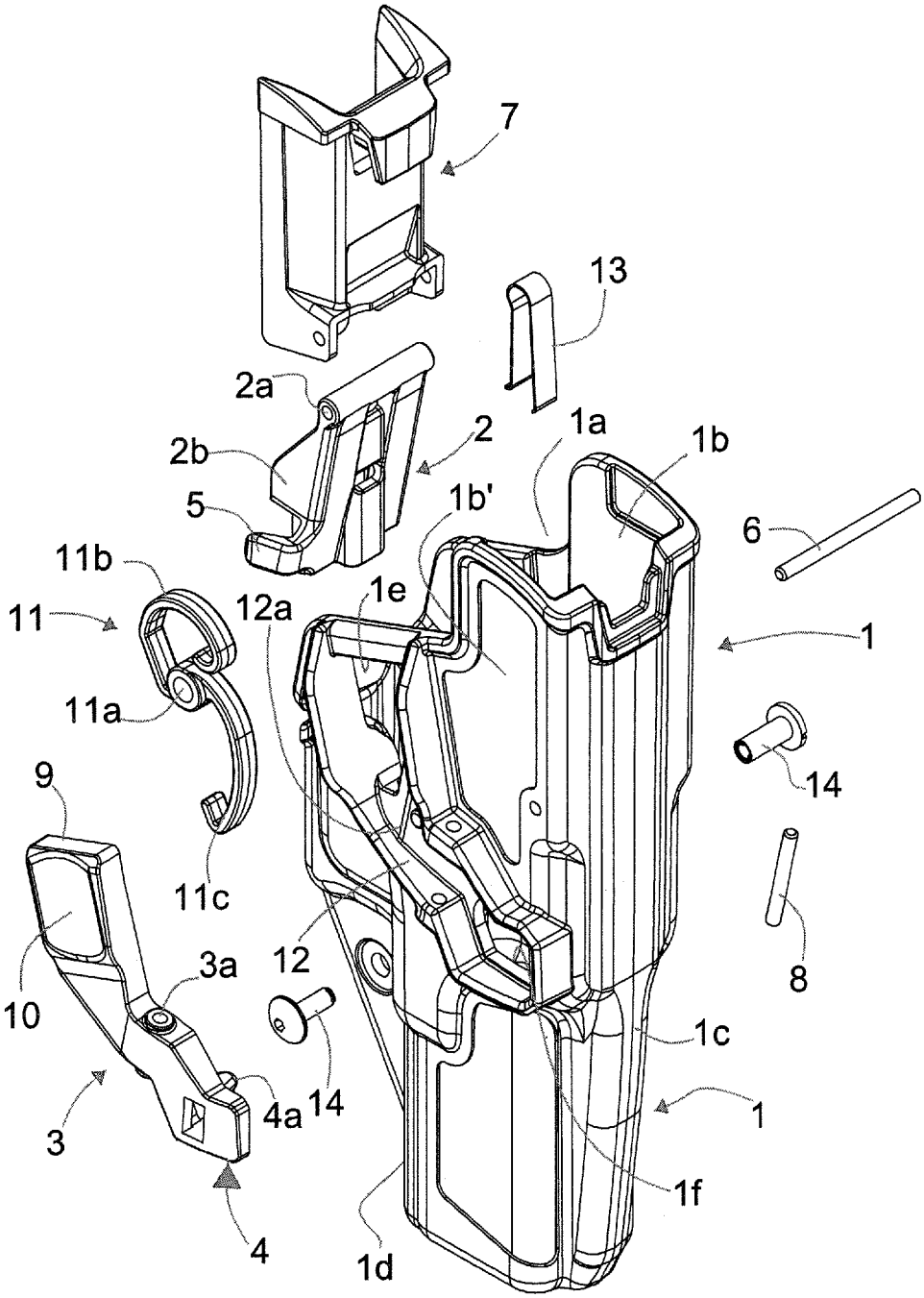
FIG. 3 is an exploded view of the holster.
Figure 4:
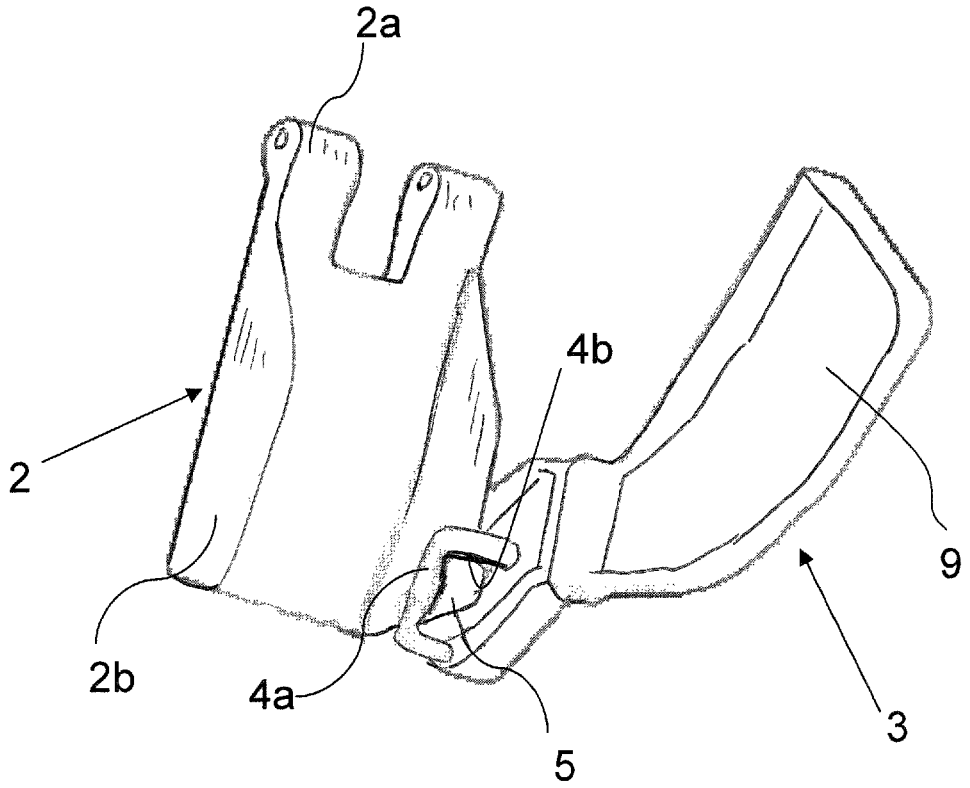
FIG. 4 is a perspective view of a detail of the locking device of the holster in the previous figures.

As mentioned, the catching end engages with the locking latch 2. More in detail, with particular reference to FIGS. 3 and 4, the end 4 has a side protrusion 4*a* with a slot 4*b* that fits with the above mentioned sideways slanting peg 5, which projects out of the body 1 through a window 1*f* formed in the side wall 1*b*', and more specifically within the housing 12*a* encircled by the ridge 12.

The slanting arrangement of the peg 5 is such that when it is caught by the protrusion 4*a* through the slot 4*b*, a rocking displacement of the latch 2 towards the release position responds to the lifting of the end 4 pursuant to the pressing actuation on the outer recess 10.

In the absence of an actuation the lever 3 is biased towards a rest position (end 4 kept close to the body 1, corresponding to a lifted, locking position of the latch 2). In this condition the latch is lifted to the inside of the body and engaged with the ejection port of the handgun. With a pressure of the forefinger on the actuation end 9 of the lever 3, the same rotates and causes the latch 2 to rock to the release position, overcoming the resistance of the spring 13 and making it possible for the user to extract the gun. As the pressure ends, the lever 3 is biased to the rest position thanks to the same flat spring 13 that urges the latch to the lifted position and via the slanting peg 5 pushes back the catching end 4 of the lever.

Preferably, a further spring device 11 is arranged inside the body 1, comprising a central fixture 11*a* for connection via screws 14 to the side walls 1*b*, and two elastic arms 11*b*, 11*c* that project from mutually opposite sides of the central fixture 11*a*, so that a first, upwards ring shaped arm 11*b* is adapted to engage with the trigger guard of the gun so as to keep the same constantly urged upwards for making the locking contact between the ejection port and the latch 2 safe and reliable. A second, arc shaped elastic arm 11*c* projects instead downwards and towards the front for making elastically urging contact with the slide region of the gun; in this way the gun is pushed close to the front wall 1*c*, this avoiding vibration and noise and in its turn assisting the locking contact with the latch 2.

When the holster is empty, the locking latch is kept pushed to the lifted, locking position by the spring 13. When the gun is inserted, it mechanically abuts against the latch making it rock towards the front wall 1*c*, until the spring 13 makes the same latch snap to the locking position.

Preferably, the actuation recess 10 of the lever 3, besides being ergonomically shaped for assisting contact and pressure of the forefinger tip, has also a knurled face so as to increase fiction and make the actuation reliable, quick and fast. The arrangement of the lever 3 according to the invention makes the actuation intrinsically easy and convenient, permitting to exploit directly the first part of the finger, i. e. the phalanx closest to the palm of the hand, in a natural and smooth continuation and completion of the same wrapping movement required to get a grip on the gun and to extract it. The actuation with the first or proximal phalanx of the forefinger (permitted by the position of the actuation end 9 and consequently by the length and arrangement of the lever 3), is in particular simple and fail-proof: a minimum flexion is required, the effectiveness of the actuation is unrelated with the size of the finger, and the lever can be actuated without having to reach for something deep down the holster. The structure and length of the lever ensures also a major finger-engagement surface area and a favourable force balance. The lever system according to the invention is furthermore suitable for both right-hand user holsters and left-hand user holsters.

A preferred embodiment of the holster provides for an obviously implemented alarm system integrated with the same holster and emitting audible sounds or vibrations in the very moment when the locking occurs. In this way the user is made sure that the gun is safely accommodated in the holster and secured thereto; at that point, only the actuation of the lever 3 will permit to remove the gun from its position.

The spatial references "top", "bottom" "up", "down", "front", "side" and the like used in the present description are obviously referred to a use arrangement of the holster when worn on a user's lap.

Variants and/or modifications can be brought to the holster support according to the present invention, without departing from the scope of the invention itself as defined by the following claims.

The invention claimed is:

1. A safety holster for handguns having an ejection port for the spent casings, comprising: a hollow body defined by two side walls joined together by a front wall and a rear wall, and adapted to receive through an opening said handgun with the ejection port adjacent to said front wall; a locking device arranged inside said body, rocking about a crosswise axis bridging across said side walls of the holster between a locking position, lifted to the inside of the body for engagement with said ejection port, and a release position close to said front wall; and a release device mounted in one of said side walls and comprising a displaceable member engaging with said locking device, the actuation of said displaceable member being adapted to displace said locking device from said locking position to said release position, elastic biasing means being arranged between said body and said locking device for biasing the same to said locking position, characterized in that said displaceable member, wherein said displaceable member is a lever pivotally mounted on the outside of said side wall of the body around an axis substantially parallel with said side wall, said lever having an actuation end in a top-back region of the body, and a catching end closer to said the front wall for engagement with a slanting peg extending from the locking device which projects out of the body through a window formed in said side wall, whereby a pressure on said actuation end causes the catching end to lift outwards, and in response the locking device to rock to said release position.

2. The safety holster according to claim 1, wherein said catching end of said lever has a side protrusion with a slot that fits with said slanting peg.

3. The safety holster according to claim 1, wherein said pivoting axis of said lever has an inclined arrangement with respect to a longitudinal direction of the body, that is the direction corresponding to the axis of the barrel of the gun in its housing arrangement within the body, the inclination being such to approach said front wall moving towards said top opening.

4. The safety holster according to claim 1, wherein said pivoting axis of said lever is defined by a pivot supported by a ridge projecting from said sidle wall and following a path that encircles the periphery of the lever, thus enclosing a housing for the same lever.

5. The safety holster according to claim 1, wherein said actuation end of said lever has a flat development with an outer recess adapted for ergonomic contact with the fleshy part of the first phalanx of the forefinger.

6. The safety holster according to claim 5, wherein said recess has a knurled or rough surface.

7. The safety holster according to claim 1, wherein in correspondence with said actuation end of said lever said side wall has a fracture, assisting the pressing movement of said actuation end towards the body.

8. The safety holster according to claim 1, wherein said locking device is a latch with a top edge along which a pin defines said crosswise axis, said slanting peg projecting sideways from a lower, free end of the latch.

9. The safety device according to claim 8, wherein said pin is pivotally mounted on a shell-like insert that reinforces the top of said front wall and of said side walls in a region enclosing said opening.

10. The safety holster according to claim 1, further comprising a spring device arranged inside said body, comprising a central fixture for connection to said side walls, and two elastic arms that project from mutually opposite sides of the central fixture, said arms comprising a first, upwards ring shaped arm adapted to engage with the trigger guard of the gun so as to keep the same constantly urged upwards, and a second, arc shaped elastic arm projecting downwards and towards the front for making elastically urging contact with a slide region of the gun.

11. The safety holster according to claim 1, further comprising a device that emits sound or vibration when said locking means reach said locking position.

* * * * *